United States Patent [19]

Benedyk

[11] 4,281,689

[45] * Aug. 4, 1981

[54] WOVEN FABRIC MADE OF LOW MODULUS, LARGE DIAMETER FIBERS

[75] Inventor: Joseph C. Benedyk, Highland Park, Ill.

[73] Assignee: Brunswick Corporation, Skokie, Ill.

[ * ] Notice: The portion of the term of this patent subsequent to Jan. 1, 1997, has been disclaimed.

[21] Appl. No.: 33,461

[22] Filed: Apr. 26, 1979

[51] Int. Cl.[3] ..... D02G 3/00; D04H 11/00

[52] U.S. Cl. ..... 139/420 A; 526/291; 526/331; 526/348

[58] Field of Search ..... 526/331, 348, 291; 428/902, 296, 297, 233, 236, 237, 241, 242, 224; 139/420 R, 420 A

[56] References Cited

U.S. PATENT DOCUMENTS

| | | | |
|---|---|---|---|
| 2,910,763 | 11/1959 | Lauterbach | 428/300 |
| 3,086,275 | 4/1963 | Pritchard | 428/394 |
| 3,293,339 | 12/1966 | Gates | 264/54 |
| 3,394,043 | 7/1968 | Parlin et al. | 428/97 |
| 3,616,184 | 10/1971 | Katagiri et al. | 428/242 |
| 3,801,428 | 4/1974 | Striegler et al. | 428/85 |
| 3,904,455 | 9/1975 | Goldman | 428/236 |
| 3,994,759 | 11/1976 | Stoller | 428/300 |
| 4,038,440 | 7/1977 | King | 428/902 |
| 4,078,128 | 3/1978 | Hoyt et al. | 526/331 |
| 4,118,530 | 10/1978 | Benedyk | 428/97 |
| 4,142,557 | 3/1979 | Kositzke | 139/420 R |
| 4,149,571 | 4/1979 | Burroughs | 139/420 R |
| 4,181,762 | 1/1980 | Benedyk | 526/331 |

*Primary Examiner*—Ronald W. Griffin

*Attorney, Agent, or Firm*—Fidelman, Wolffe & Waldron

[57] ABSTRACT

A woven fabric consisting of warp and filling yarns made from fibers or filaments having a low modulus of elasticity and a large diameter. The fibers can be of any cross-sectional shape but have a moment of inertia of from $400\times10^{-14}$ in.$^4$ to $7.8\times10^{-9}$ in.$^4$ and an elastic modulus of from 2,000 to 80,000 p.s.i. These values correspond to a range of circular diameters of from 0.003 to 0.020 in. The fibers can be loaded with high amounts of fillers, such as pigments, color agents, flame retardants, antistatic agents, antisoiling agents, or antioxidants.

30 Claims, 1 Drawing Figure

WOVEN FABRIC MADE OF LOW MODULUS, LARGE DIAMETER FIBERS

CROSS-REFERENCES TO RELATED APPLICATIONS

Figure 1:
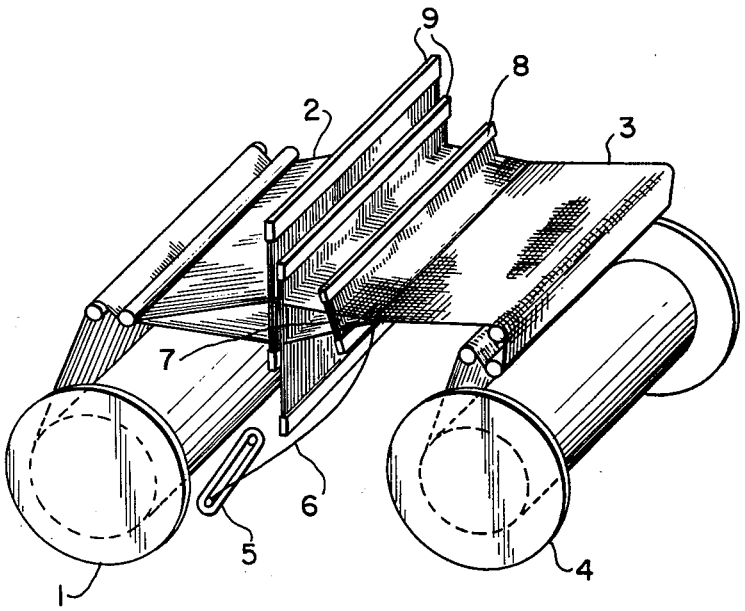

This application is related to the co-pending application Ser. No. 17,465 of Joseph C. Benedyk, entitled "Fibers, Yarns and Fabrics of Low Modulus Polymer", now U.S. Pat. No. 4,181,762 issued Jan. 1, 1980, the disclosure of which is incorporated herein by reference.

FIELD OF THE INVENTION

The present invention relates to a woven fabric consisting of warp and filling yarns made of large diameter, low modulus fibers having an area moment of inertia, I, of from $400\times10^{-14}$ inch$^4$ (in.$^4$) to $7.8\times10^{-9}$in.$^4$. These values of I correspond to a range of circular diameters of from 0.003 in. to 0.020 in., although the fibers can be of any cross-sectional shape.

Fibers sized in this range are not currently used in woven fabrics. Such fibers are, however, found in commerce, as, for example, in high strength plastic monofilament mesh and high strength monofilament woven erosion control fabrics.

BACKGROUND OF THE INVENTION

It is an object of this invention to provide fabrics for decorative and functional purposes, unlike the engineering fabrics mentioned above. Thus, a woven fabric of the instant invention contains a plurality of large diameter, low modulus filaments or fibers in yarn form, this yarn being used for warp and/or fill yarns.

In order to produce a soft hand and acceptable drape for decorative functional uses such as drapes, curtains, wall coverings, seat covers, table cloths, etc., the fibers utilized in the invention have an unusually low modulus of elasticity ($E_f$) relative to conventional fibers. The range of the modulus of elasticity of the fibers is from 2,000 to80,000 pounds/inch$^2$ (p.s.i.). Such fibers, with moments of inertia of from $400\times10^{-14}$ in.$^4$ to $7.8\times10^{-9}$ in.$^4$, will have a stiffness parameter, as defined below, in the range of $8.0\times10^{-9}$ to $62.4\times10^{-5}$ p.s.i. Thus, in spite of the large dimensions of the cross-sections of the fibers, they still remain flexible and supple because of their extremely low values of elastic modulus compared to conventional fibers.

By "large diameter fibers" is meant fibers of any synthetic polymer having a diameter in a range of from about 0.003 to 0.020 in., preferably from about 0.006 to about 0.015 in. These fibers usually have a denier of from 25 to 500 for fibers made of material having a specific gravity in the range of from about 0.90 to about 1.4. The modulus of elasticity ($E_f$) is determined by measuring the initial slope of the stress-strain curve derived according to the American Society for Testing Materials Manual, Standard Method No. D2256-69. Strain measurements are corrected for gauge length variations by the method described in an article. entitled "A Method for Determining Tensile Strains and Elastic Modulus of Metallic Elements," American Society for Testing Materials Transactions Quarterly, 60(4):726-727 (1967).

By "a fiber having a low modulus of elasticity" is meant a fiber with a modulus of elasticity of from about 2,000 to about 80,000 p.s.i.

Under normal loading conditions, fibers bend about a neutral axis where the moment of inertia will be a minimum value. The moment of inertia ($I_f$) about this neutral axis is calculated using the following equation:

$$I_f=\int y^2 dA$$

where dA is any incremental area of the fiber cross-section and y is the distance any such incremental area is from the neutral axis. The above equation illustrates that the moment of inertia of the fiber is a function of the cross-sectional configuration of the fiber. Thus, the hand of a fiber may be altered by changing its cross-sectional configuration. Specific examples of fibers having different cross-sectional configurations and the specific equations for calculating the moments of inertia for such fibers are given in a paper presented at the 47th Annual Meeting of the American Society for Testing Materials, and published in Vol. 44 (1944). For example, for a circular cross-section $$I=\frac{\pi d^4}{64}$$

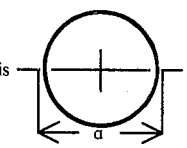

wherein d is the fiber diameter.

The cross-sectional configuration of the fiber is not critical so long as the moment of inertia falls within the range of from about $400\times10^{-14}$ in.$^4$ to about $7.8\times10^{-9}$ in.$^4$. However, the fibers preferably have a generally circular cross-section. Such a fiber would have to have a diameter in a range of from 0.003 in. to about 0.020 in. in order to have the required moment of inertia.

The fiber stiffness is a function of the material properties of the fiber, the geometry of the fiber, and the manner in which load is applied to the fiber. In general terms, one may compare the hand of different fibers by comparing the stiffness parameter of the fibers, where each fiber has a uniform cross-section and is composed of the same material throughout. This stiffness parameter ($K_f$) is the product of the elastic modulus ($E_f$) of the fiber and the area moment of inertia ($I_f$) of the fiber:

$$K_f=E_f\times I_f.$$

Because of the extremely large cross-section of the fibers utilized in the invention, yarn made from them will contain fewer fibers per bundle than conventional yarns. For example, a 1000 den. yarn made of 5 denier (den.) nylon filaments or fibers (5 den. is equivalent to a 0.001 in. diameter circular nylon fiber) will have 1000/5, or 200 filaments or fibers. A 1000 den. yarn made of 100 den. filaments or fibers of the invention will have 1000/100, or 10, filaments or fibers.

Fabrics made from yarns with low modulus, large diameter fibers could be as flexible as those made with conventional nylon, polyester, acrylic, cotton, wool or blended yarns. The stiffness of a yarn is approximately given by the following equation:

$$S=n\cdot E_f\cdot I_f$$

where n=number of filaments in the yarn $E_f$=modulus of elasticity (of the fiber in p.s.i.)

$I_f$=moment of inertia (of fiber cross-section in in.)

The stiffness of a fabric of a given construction, i.e., a given number of warp and filling yarns per unit area, is related directly to the yarn stiffness. For similar woven constructions, the stiffness of a fabric made of yarns with low modulus, large diameter fibers (A) can approximate that of a conventional fabric (B) if the yarn stiffnesses are made equal:

$$(nE_fI_f)_A=(nE_fI_f)_B$$

For example, for yarns of equivalent denier, $$n=\frac{\text{yarn denier}}{\text{fiber denier}}=\frac{dn_y}{dn_f},$$

$$\text{Thus, }\left(\frac{dn_y}{dn_f}\cdot E_f\cdot I_f\right)_A=\left(\frac{dn_y}{dn_f}\cdot E_f\cdot I_f\right)_B$$

and if $(dn_f)_A=100$, $(dn_f)_B=5$, and $(dn_y)_A=(dn_y)_B=1000$, then $$(10E_fI_f)_A=(200E_fI_f)_B$$

Now, if $(I_f)_A=3.068\times10^{-11}$ in.$^4$, $(I_f)_B=4.9\times10^{-14}$ in.$^4$ and $(E_f)_B=500{,}000$ p.s.i., then the value of $(E_f)_A$ required for equivalent yarn stiffness is $$(E_f)_A=\frac{200\times5\times10^5\times4.9\times10^{-14}}{10\times3.068\times10^{-11}}\text{ p.s.i.}$$
$$=15{,}970\text{ p.s.i.}$$

This falls within the elastic modulus range for fibers utilized in the invention (2,000 to 80,000 p.s.i.).

FIBER MATERIAL

One of the chief criteria for selecting a polymeric material for the fibers utilized in the present invention is its elastic modulus. The best material so far uncovered is an ethylene-vinyl acetate copolymer having a vinyl acetate content ranging from about 1 to about 10 percent by weight and a melt index of from about 0.5 to about 9. This material will provide the monofilament with the desired elastic modulus and is also relatively inexpensive. The following thermoplastic materials will provide the monofilament with an elastic modulus within the range of from 2,000 to 80,000 p.s.i.: (a) plasticized polyvinyl chloride, (b) low density polyethylene, (c) thermoplastic rubber, (d) ethylene-ethyl acrylate copolymer, (e) ethylene-butylene copolymer, (f) polybutylene and copolymers thereof, (g) ethylene-propylene copolymers, (h) chlorinated polypropylene, (i) chlorinated polybutylene, or (j) mixtures of these thermoplastics.

Although the ethylene-vinyl acetate copolymer has the desired elastic modulus, one problem with this material is that it has a relatively low melting point. To obviate this problem and increase the heat resistance of the fiber, the molecules of the copolymer are cross-linked. Cross-linking may be achieved during the manufacture of the fiber or subsequently. Irradiation techniques discussed in copending application Ser. No. 30,911 of Curtis C. Allen, which is incorporated herein by reference, may be employed. Alternatively, the molecules of the polymer may include moieties which react under selected conditions with other molecules to effect cross-linking. As will be discussed below in detail, it is desirable to use certain additives which greatly enhance cross-linking. Normally, partial cross-linking is desired so that the material retains the required elastic properties. Ordinarily, cross-linking increases the melting point of the material so that it is 200° F. or greater.

The degree of cross-linking should be sufficient to provide a gel content greater than 30% but less than 90%. The preferred gel content is 45–55%. Gel content of the ethylene-vinyl acetate fiber, for example, is determined according to the following procedure:

Fibers are wound around a metal wire screen and subjected to solvent elution in hot xylene near the boiling point for 24 hours. Gel content is then calculated using the formula:

$$\%\text{ gel}=W_f/W_o\times100$$

where $W_o$ is the initial weight of the sample and $W_f$ is the final weight after elution.

Of course, these fibers may be twisted together with other monofilament fibers to form yarns suitable for use in the present invention.

The woven fabric of the present invention has a high shrink rate relative to woven fabrics of the prior art when exposed to intense heat. This property, in combination with the ability of these fibers to hold large amounts of fire retarding agents, is of value for applications in which the fabric must be located near a heat source.

Additional properties of the fibers described above and methods for making same are discussed in the previously referenced application Ser. No. 17,465 of Joseph C. Benedyk.

In general, due to the large fiber diameter, the fibers utilized in the invention can be loaded with fillers to higher levels than conventional fibers. Specifically, pigments may be used to color the fiber. Such pigments may be dispersed throughout the molten polymeric material prior to extrusion. These pigments will normally have a particle size in the range of from about 1 to about 25 microns. The amount of pigment normally ranges between about 0.5 and about 20% of the total weight of the blend.

Exemplary of the pigments which may be employed are organic colorants such as phthalocyanine green and inorganic colorants such as cadmium yellow. Any commonly available colorant which is compatible with the polymer compositions may be used. Fillers which may be used include, for example, silica aerosils, calcium silicate, aluminum silicate, carbon black and alumina in a weight percent as high as 20% or more. Obviously, some of the mineral fillers may also serve as pigments and vice versa, e.g., carbon black and titanium dioxides.

In one embodiment of the invention, pellets of color concentrate are initially prepared. These color concentrate pellets are blended in the extruder with non-colored pellets. The colored and non-colored pellets then melt and mix together thoroughly during the extrusion. It is also possible to color the fiber with a dispersed dye, but under some conditions this type of dye tends to bleed out of the fiber. Cross-linking subsequent to dyeing tends to fix these dyes.

In addition to coloring agents and fillers, it is possible to include in the fiber well known and available flame retardants, antistatic agents, or antisoiling agents. Antioxidants and stabilizers may likewise be added, such as for example, unsaturated benzophenone derivatives described in U.S. Pat. No. 3,214,492, N-N′ dinaphthyl p-phenylene diamine, or Irganox 1010, a multi-functional antioxidant having four sterically hindered phenolic groups, available from Ciba-Geigy. Because of the low melting point of the polymers used in the manufacture of the fiber, they can also use additives, especially dyes, flame retardants, antistatic agents and antisoiling agents, which are sensitive to, or degrade at, temperatures necessary to process nylon into fiber.

Extrusion temperatures used with certain of the fiber-forming polymers, especially with ethylene-vinyl acetate copolymers, do not exceed 500° F. This relatively low extrusion temperature allows one to use hydrated magnesia as a flame or fire retardant. Hydrated magnesia will release its contained water rapidly at temperatures above about 500° F., a property which precludes its use with nylon and similar polymers. As is well known in the art, hydrated magnesia is a low cost, highly effective fire retardant but, prior to this time, one which could not be used in thermoplastic fibers.

METHOD FOR MAKING WOVEN FABRIC

Basically, the present invention comprehends processes of all types suitable for producing the woven fabrics of the invention. For purposes of clarity and simplicity, the principles of the invention will be set forth in a particular method and apparatus for weaving, but it is to be understood that the invention is not to be limited to this description.

FIG. 1 is a perspective view of a conventional loom which may be utilized to make the woven fabric of the invention.

A beam 1 at one end of the loom holds the warp yarn 2 and the woven cloth 3 is wound on a beam 4 at the other end of the loom. A shuttle 5 carries the filling yarn 6 through the shed 7 and a reed 8 beats the filling yarn 6 back into the cloth to make the weave firm. The warp yarn 2 is raised and lowered by harnesses 9 which hold a number of heddles (not shown) through which the warp yarn 2 is threaded.

Weaving consists of three steps: shedding, picking and beating up. Shedding involves the raising of one or more harnesses to separate the warp yarns 2 to form a shed 7. In the picking step the shuttle 6 is passed through the shed 7 to insert the filling yarn 6. Finally, during the beating up step the reed 8 pushes the filling yarn 6 back into place in the cloth 3 to make the weave firm.

It may readily be seen that the loom described above may be modified by techniques known in the art. For example, any number of harnesses may be used, and the shuttle may be replaced by a water jet, air jet or rapier-type system.

EXAMPLE I

A fabric 48 in. wide is woven in a plain weave on a standard loom from a warp yarn consisting of 20 filaments of ethylene-vinyl acetate copolymer, each filament having an elastic modulus of about 16,000 p.s.i. and an area moment of inertia of about $3.1\times10^{-11}$in.$^4$. The filling yarn consists of 18 filaments of the same material. The fabric is woven to a final count of 11 warp ends per in. and 20 picks per in.

The present invention also contemplates woven fabrics consisting of warp yarn made of large diameter, low modulus fibers and filling yarn made of any other fiber, natural or synthetic, conventionally used in the art. Additionally, woven fabric of this invention may have filling made of large diameter, low modulus fibers and warp consisting of conventional fibers.

It is to be understood that the foregoing detailed description of various aspects of the present invention is for purposes of illustration only, and that many variations may be made in the invention without departing from the spirit thereof.

What is claimed is:

1. A woven fabric, comprising: yarn made of a polymeric fiber having an elastic modulus of from about 2,000 to about 80,000 p.s.i., an area moment of inertia of from about $400\times10^{-14}$ to about $7.8\times10^{-9}$in.$^4$, and a stiffness parameter of from about $8.0\times10^{-9}$ to about $62.4\times10^{-5}$ p.s.i., said fiber providing said woven fabric with a high shrink rate when exposed to intense heat.

2. The woven fabric of claim 1, wherein the fiber is a thermoplastic polymer.

3. The woven fabric of claim 2, wherein the molecules of the thermoplastic polymer are partially cross-linked.

4. The woven fabric of claim 3, wherein the molecules are cross-linked to the extent that the gel content is greater than 30% but less than 90%.

5. The woven fabric of claim 4, wherein the thermoplastic polymer has a melting point of 200° F. or greater after cross-linking.

6. The woven fabric of claim 2, wherein the thermoplastic is selected from the group consisting of plasticized polyvinyl chloride, low density polyethylene, ethylene-ethyl acrylate copolymer, polybutylene and copolymers thereof, ethylene-propylene copolymers, chlorinated polypropylene, chlorinated polybutylene, and mixtures thereof.

7. The woven fabric of claim 1, further comprising from 0.5 to 20 weight percent of additives dispersed throughout the polymer.

8. The woven fabric of claim 7, wherein the additives have a particle size of from 100 to 250,000 angstroms.

9. The woven fabric of claim 1, wherein the fiber in the unbulked state has a generally circular cross-section.

10. The woven fabric of claim 9, wherein the fiber has a diameter from 0.003 to 0.020 inches.

11. The woven fabric of claim 9, wherein the fiber is bulked.

12. The woven fabric of claim 1, wherein the fiber has a denier of from 25 to 500 for material having a specific gravity in the range of from 0.90 to 1.4.

13. The woven fabric of claim 1, wherein the polymeric material is an ethylene-vinyl acetate copolymer having a vinyl acetate content of from 1 to 10 percent by weight and a melt index of from 0.5 to 9.

14. The woven fabric of claim 1, further comprising hydrated magnesia dispersed throughout the polymer.

15. The woven fabric of claim 1, further comprising oxides of silicon or titanium dispersed throughout the polymer.

16. A method of producing a woven fabric, comprising: weaving warp and filler yarns, wherein at least one of the yarns is made of a polymeric fiber having an elastic modulus of from about 2,000 to about 80,000 p.s.i., an area moment of inertia of from about $400\times10^{-14}$ to about $7.8\times10^{-9}$in.$^4$, and a stiffness parameter of from about $8.0\times10^{-9}$ to about $62.4\times10^{-5}$ p.s.i., said fiber providing said woven fabric with a high shrink rate when exposed to intense heat.

17. The method of claim 16, wherein the fiber is a thermoplastic polymer.

18. The method of claim 17, wherein the molecules of the thermoplastic polymer are partially cross-linked.

19. The method of claim 18, wherein the molecules are cross-linked to the extent that the gel content is greater than 30% but less than 90%.

20. The method of claim 19, wherein the thermoplastic polymer has a melting point of 200° F. or greater after cross-linking.

21. The method of claim 20, wherein the thermoplastic is selected from the group consisting of plasticized polyvinyl chloride, low density polyethylene, ethylene-ethyl acrylate copolymer, polybutylene and copolymers thereof, ethylene-propylene copolymers, chlorinated polypropylene, chlorinated polybutylene, and mixtures thereof.

22. The method of claim 21, further comprising from 0.5 to 20 weight percent of additives dispersed throughout the polymer.

23. The method of claim 22, wherein the additives have a particle size of from 100 to 250,000 angstroms.

24. The method of claim 16, wherein the fiber in the unbulked state has a generally circular cross-section.

25. The method of claim 24, wherein the fiber has a diameter from 0.003 to 0.020 inches.

26. The method of claim 24, wherein the fiber is bulked.

27. The method of claim 16, wherein the fiber has a denier of from 25 to 500 for material having a specific gravity in the range of from 0.90 to 1.4.

28. The method of claim 16, wherein the polymeric material is an ethylene-vinyl acetate copolymer having a vinyl acetate content of from 1 to 10 percent by weight and a melt index of from 0.5 to 9.

29. The method of claim 16, further comprising hydrated magnesia dispersed throughout the polymer.

30. The method of claim 16, further comprising oxides of silicon or titanium dispersed throughout the polymer.

* * * * *